United States Patent [19]

Moriarty et al.

[11] 4,126,174

[45] Nov. 21, 1978

[54] FLEXIBLE SHEET ROLLUP WINDOW STRUCTURE

[76] Inventors: James P. Moriarty, 1007 S. High St.; Craig N. Birhanzl, 131½ E. Deshier, both of Columbus, Ohio 43206

[21] Appl. No.: 817,165

[22] Filed: Jul. 20, 1977

[51] Int. Cl.[2] ..... A47H 3/00; E06B 9/17

[52] U.S. Cl. ..... 160/266; 160/271

[58] Field of Search ..... 160/241, 242, 266–273, 160/290

[56] References Cited

U.S. PATENT DOCUMENTS

| | | | |
|---|---|---|---|
| 768,416 | 8/1904 | Woods | 160/266 |
| 768,417 | 8/1904 | Woods | 160/266 |
| 1,241,425 | 9/1917 | Nelson | 160/266 |
| 1,911,232 | 5/1933 | Large | 160/266 |
| 2,624,403 | 1/1953 | Zelenko | 160/290 |
| 3,430,677 | 3/1969 | Pierce | 160/271 |

FOREIGN PATENT DOCUMENTS

| | | | |
|---|---|---|---|
| 2,411,746 | 9/1975 | Fed. Rep. of Germany | 160/271 |

*Primary Examiner*—Peter M. Caun

*Attorney, Agent, or Firm*—Mahoney & Stebens

[57] ABSTRACT

A flexible sheet rollup window structure used in conjunction with a conventional window sash frame as an auxiliary or storm window. The invention includes an elongated sheet of thin, flexible plastic material (vinyl) which is designed to be supported and stored or dispensed by means of elongated spring rollers. An auxiliary guide roller is provided to direct the film into a straight-line plane. A lower end of the sheet of material is provided with a structurally rigid edge lockable structure, with the support roller and guide roller being mounted at the upper end. A horizontal sealing element is secured to a surface of the film and is automatically brought into sealing engagement with the upper end of the window frame when the sheet is placed in a closed position with respect to the window frame. Additional sealing of the sheet of material is effected by longitudinally extending, vinyl sealing strips or ribs that are dielectrically welded to one surface of the sheet adjacent each longitudinal edge thereof. The marginal edge portions of the vinyl sheet are provided with at least two parallel spaced apart sealing ribs.

17 Claims, 8 Drawing Figures

FLEXIBLE SHEET ROLLUP WINDOW STRUCTURE

BACKGROUND OF THE INVENTION

This invention is directed to the providing of a suitable auxiliary or storm window structuure which is utilized in combination with a conventional window sash. Many types of structures have been heretofore developed for that purpose with the most common and oldest type being a rigid frame provided with one or more panes of glass. A storm window of that construction is generally adapted to being mounted exteriorally of the primary window sash and it is this mounting which presents substantial problems that prevent its widespread continued utilization. The first and obvious problem is that such a window can only be safely installed from the exterior of the building structure. This is readily accomplished in one or two story dwellings but is an unacceptible type of mounting for the high-rise, multiple story buildings where such mountings would require the use of scaffolding or other exterior support means for the workers. A second major disadvantage to the use of such storm windows in multi-story buildings is that most building code regulations concerning such structures require that the windows be capable of being readily opened from the interior of the associated room. This is a very important feature with respect to public buildings such as hotels where a quick means of emergency egress is essential. Also, the ability to open a window to obtain ventilation is particularly advantageous.

Another important type of window, or window which can provide the same advantages of the double hung sash type, is a twin panel glass variously designated as a thermal pane window. While these dual panel structures do provide an acceptable degree of thermal insulation as to the glass itself, these structures are totally dependent on the ability of a supporting frame to maintain an adequate weather seal with respect to the mounting frame. Where commercial buildings incorporate metal frames for such windows, this is difficult to achieve without extensive and repeated caulking and sealing efforts. Also, this type of window is particularly expensive.

A third and newer technique attempting to provide a suitable auxiliary or storm window is the use of thin sheets of plastic materials, either rigid or flexible, that are relatively inexpensive. The flexible plastic sheets are generally designed to be secured to the window frame by frame elements that are often not structurally self-supporting to maintain the low cost. While this type of mounting can be achieved, these windows require substantial time for installing. The rigid sheets also are difficult to install and require a substantial amount of time for installation. Furthermore, these windows which may be mounted either interiorally or exteriorally of the conventional sash, often can only be mounted in a relatively permanent manner. They are not adapted to be readily removed without use of tools such as screw drivers and other similar implements and removal procedures often result in a high percentage of breakage. Consequently, auxiliary or storm windows of this construction are totally unacceptable in commercial buildings and residence structures such as hotels, where the residents must be enabled to quickly remove or open the windows for ventilation or emergency egress in the event of fire.

SUMMARY OF THE INVENTION

In accordance with this invention, a rollup-type window structure is provided for advantageous use as an auxiliary window, or storm window, in conjunction with a conventional window sash. The rollup window structure of this invention is formed from an elongated sheet of flexible plastic material such as the readily available clear vinyl plastic films. Through a novel sealing and weather stripping technique, incorporated and applied to the flexible sheet of plastic material, the window structure of this invention, is enbled to be carried and supported on a reel or roller-type element. This unique weather stripping application combines with a sheet of thin plastic film that is otherwise incapable of being self-supporting, to form a rigid structure on a support and storage roller so as to permit the sheet of plastic film to be rolled up into compact cylinder and maintained in the proper position. It is the novel application of weather stripping in combination with a sheet of plastic film which enables the rollup of a sheet of thin flexible film on a storage roller. Additionally, the sheet of film is adapted to be trained along a vertical plane in closing relationship to the window opening with the lateral side edges of the film disposed within longitudinally extending, guide and sealing elements to side walls of the window frame.

The novel application of vinyl strips or ribs to the surface of such a flexible sheet of material to enable the rollup of a flexible film on a roller includes the addition of a pair similar sized and dimensioned strips of the sealing elements in spaced relationship along each marginal edge of the film. This arrangement of the spaced parallel strips of vinyl forming ribs results in the formation of a relatively rigid cylinder that will wrap around the support and storage roller as the film is rolled up onto the roller. Use of only one narrow strip results in a very unstable structure that is incapable of being rolled up in such a manner and it is essential that the sheet be provided with at least one such strip to effect the weather seal.

In addition to achievement of the primary objective of providing a rollup window structure utilizing a thin sheet of flexible plastic film, this invention provides a window structure which achieves a particularly effective seal with respect to the window frame at all four sides. An exceptionally tight weather seal is obtained with respect to the sides of the window frame by guiding the lateral longitudinal edge portions through side seal guide elements. A seal is formed at the top of the window frame by a transversely extending strip of weather sealing material which is secured to the flexible plastic film at a point to engage the window frame when the window is fully extended. A weather tight seal is also obtained at the bottom of the window frame by means of a structurally rigid bar that cooperates with the longitudinal and vertically disposed guide elements and is adapted to be locked against the bottom of the window frame. A recoil spring is preferably incorporated in the support and storage roller to enable the structure to be self-winding to an open or retracted position.

A further important advantage of the inventive structure is that the window may be readily mounted on the interior of a building and thus greatly facilitates installation. This interior mounting is of particular advantage in connection with high rise, multi-story buildings as the relatively costly and dangerous aspects of exterior mounted windows is avoided. A further advantage of this structure is that, with the interior mounting and the rollup feature, there is no difficulty to be experienced in opening the window should it become necessary to obtain emergency egress from a room, thus fully complying with essentially all building code regulations, or to obtain ventilation.

These, and other objects and advantages of this invention, will be readily apparent from the following detailed description of an illustrative embodiment of the invention and the accompanying drawings.

DESCRIPTION OF THE DRAWING FIGURES

DESCRIPTION OF THE ILLUSTRATIVE EMBODIMENT

Figure 1:
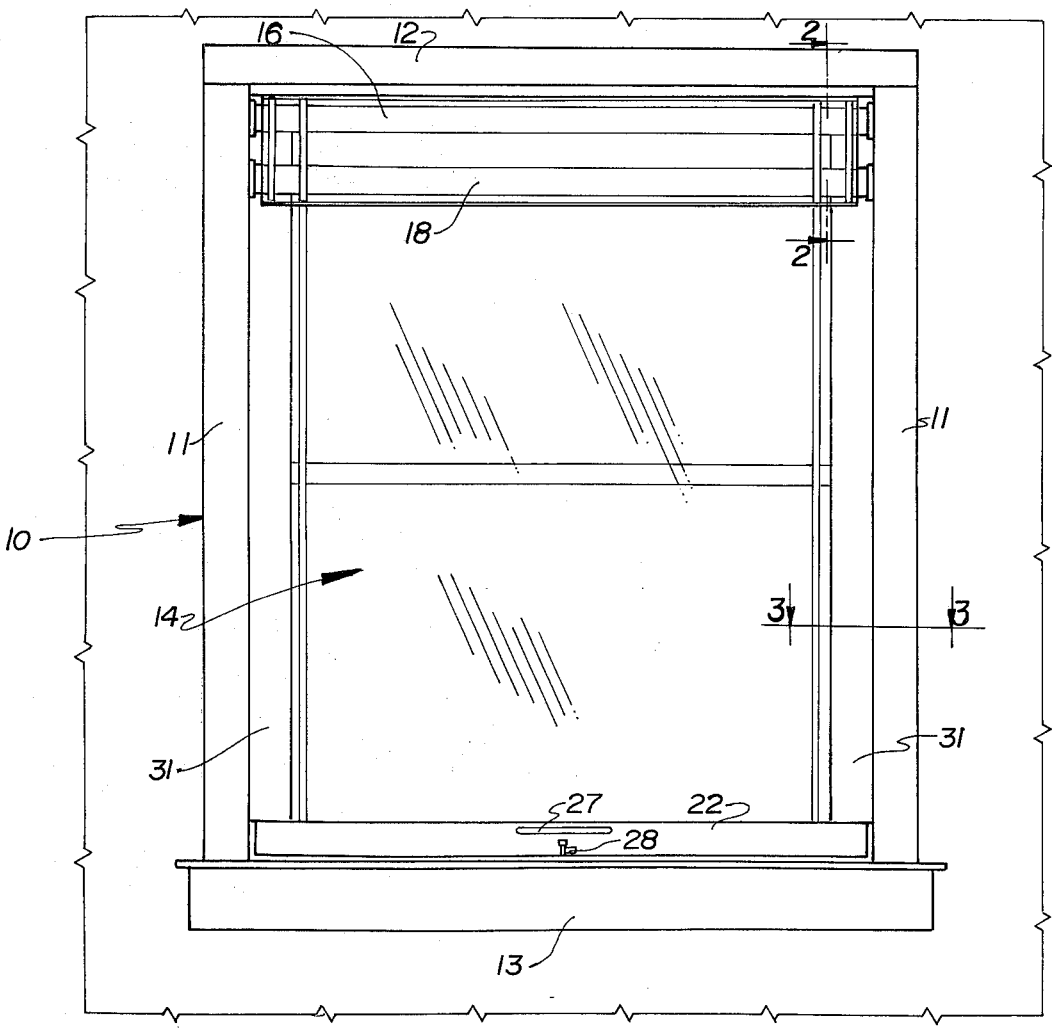
FIG. 1 is an elevational view of a window structure embodying this invention mounted in a window opening.

Having reference to FIG. 1, there is shown an emplarary window frame 10 as conventionally mounted in a vertical wall of a building structure. This frame includes a pair of laterally spaced, elongated side members 11 that are vertically oriented in the building wall and first and second end members 12 and 13 extending transversely between the side members at the upper and lower ends of the window respectively. These members 11, 12 and 13 of the window frame define a rectangularly shaped window opening in which is disposed a conventional glass-pane window sash or structure and in which is also supported a rollup window structure 14 of this invention. In FIG. 1, the window frame 10 is shown as seen from the interior of the building structure and the rollup window structure of this invention indicated generally at 14, is thus seen in this view while substantially obscuring the visual representation of conventional glass-type, double hung window sash. However, elements of the conventional window sash are illustrated in the fragmentary sectional views of FIGS. 2 and 3 for illustrating the spaced parallel relationship and disposition of the conventional window sash S and the rollup window structure of this invention 14 within the peripheral members 11, 12 and 13 defining the opening of these window frames.

In accordance with this invention, the rollup window structure 14 includes, as the element for selectively covering and closing the window frame opening, an elongated, thin transparent sheet formed from a substantially air impervious flexible material such as a clear vinyl plastic. This sheet, indicated at 15, is supported by apparatus and mechanisms provided in accordance with this invention to enable the sheet to be selectively positioned in closing relationship to the window frame opening or to the retracted therefrom into a stored position. This structural arrangement and apparatus thus enables achievement of an important primary objective of this invention which is to permit the window opening to be readily cleared for egress from the room in the event of an emergency situation by providing ready access for opening of the conventional window sash S. This arrangement also readily permits the window to be opened for ventilation purposes.

Supporting the thin sheet 15 within the window opening is a guide roller 16 which comprises an elongated cylindrical element disposed in the uppermost portion of the window frame 10 and closely adjacent the upper or first end member 12. This guide roller 16 is of a length to extend substantially across the window opening in inwardly spaced relationship to the conventional sash S. The guide roller is supported at each end by appropriate brackets 17 which are secured to the inwardly facing surfaces of the vertical side members 11 with the sheet 15 suspended vertically downward in tangential relationship to that rollers surface.

Figure 4:
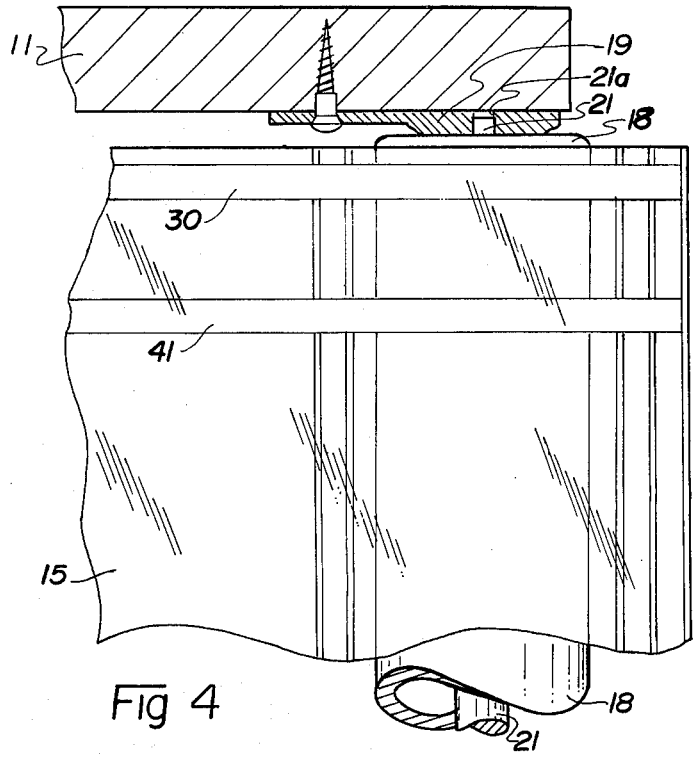
FIG. 4 is a fragmentary horizontal sectional view on a further enlarged scale taken along line 4—4 of FIG. 2.

A storage roller 18 is also provided and forms a convenient means of rolling the thin sheet 15 into a cylindrical tube for storage. This storage roller 18 is also an elongated cylindrical element which extends transversely across the window opening and is supported at each end on the vertically disposed side members 11. Suitable attachment brackets 19 are also provided for mounting of the storage roller 18 on the window frame. These attachment brackets 19 may be of a type which can be secured to the inwardly facing surfaces of the side members 11 as can be best seen in FIGS. 2 and 4. Also, as can be best seen in FIG. 2, it will be noted that the guide roller 16 is positioned a distance horizontally from the storage roller 18 and that the storage roller is located at a slightly lower elevation. This arrangement enables the thin sheet 15 to be trained over the guide roller 16 and then extend vertically downwardly in the window frame.

Figure 2:
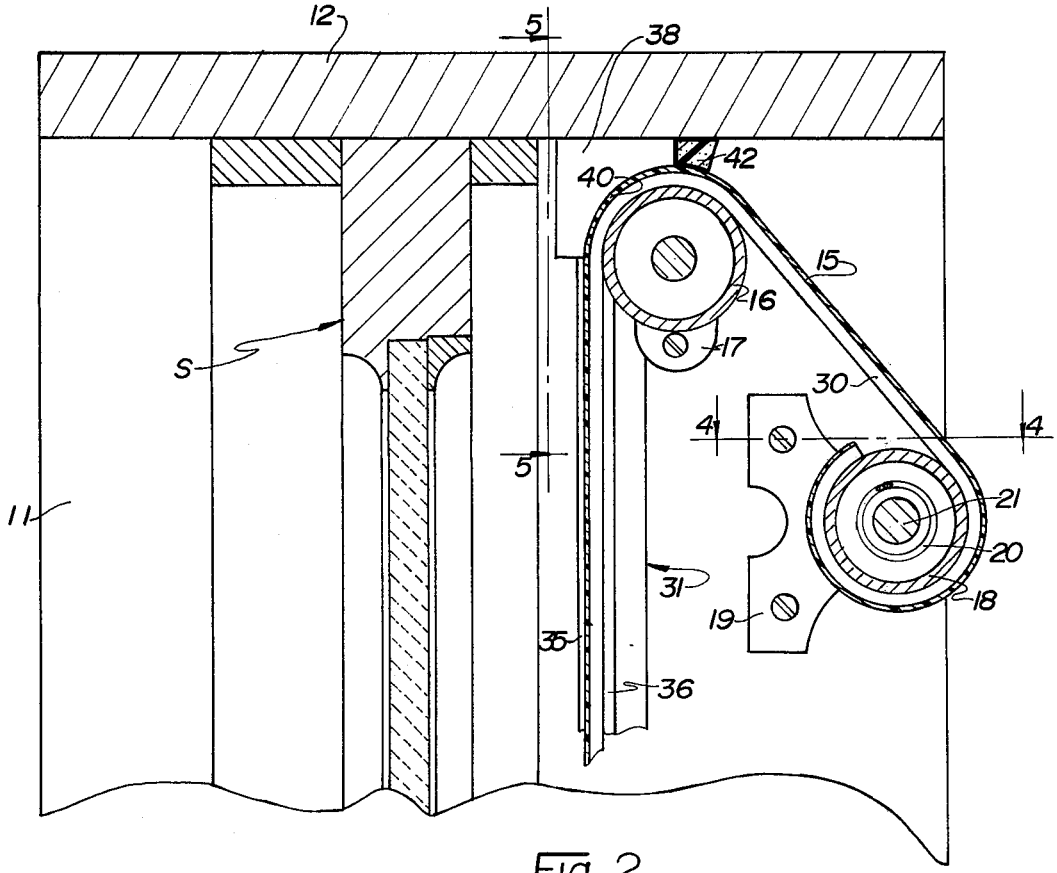
FIG. 2 is a fragmentary vertical sectional view on a substantially enlarged scale taken along line 2—2 of FIG. 1.

The storage roller 18 is preferably of a type which has an automatic spring rewind for returning the film 15 to its rolled up storage position. Accordingly, the roller 18 is fabricated to include a tubular section in which is mounted a recoil or rewind spring 20 as seen in FIG. 2. This rewind spring 20 is secured at one end to the roller 18 and the opposite end thereof is secured to a supporting shaft 21 which projects through an end wall of the roller and into a restraining socket 21a formed in the one attachment bracket 19. The roller is relatively rotatable on the shaft 21.

Figure 6:
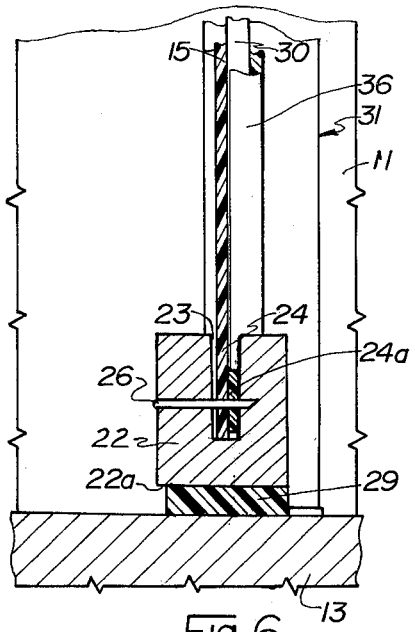
FIG. 6 is a fragmentary vertical sectional view taken along line 6—6 of FIG. 3.

One end of the elongated thin sheet 15 is secured to the outer surface of the storge roller 18 by a suitable adhesive which is effective in maintaining the sheet attached to the surface of this roller. The opposite end of the sheet 15 is provided with a structurally rigid pull bar 22. This pull bar 22, as can also be seen in FIGS. 6 and 7, includes a longitudinally extending, upwardly opening slot 23 which is of width suitable for receiving a terminal end portion 24 of the film 15. A vertically extending slot 25 is formed in each end of the bar and aligns with the longitudinal slot 23 but is of greater width. The film 15 is secured in the slot 23 by an elongated strip of adhesive **24*a* and a plurality of fastening devices 26 such as staples extending through the bar 22, adhesive strip 15*a* and the film end portion 24 as shown in FIG. 6. An operating handle 27** is also preferably provided and is secured to the center area of the inner element 23 of the pull bar. A latching mechanism 28 is also provided to secure the pull bar 22 in closed relationship to the bottom or second end member 13 of the window frame 10 and thus assure that the sheet 15 will be maintained in closing relationship to the window frame opening against the rewinding force of the spring 20 in the storage roller. This latching mechanism 28 may be of any conventional and commercially available type which may be readily actuated to release the pull bar and enable one to assist in pushing the pull bar upwardly if necessary to assist the rewind spring 20 in retracting the film into a stored position on the storage roller 18.

A bottom horizontally extending edge 22*a* of the pull bar is preferably provided with a strip of weather sealing material 29 which may be adhesively bonded to the surface of that element. This weather sealing strip 29 may be of any conventional type and is slightly compressible and of a thickness to accommodate the operation of a latching mechanism 28. When the pull bar 22 is latched in a closed position, the weather strip 29 is slightly compressed and thus engages the inwardly facing surface of the bottom end member 13 of the window frame to effectively prevent passage of air between those two structural elements.

Sealing of the longitudinally extending side edge portions of the sheet 15 with respect to each side member of the window frame is accomplished in accordance with this invention by means of a longitudinally extending strip 30 of vinyl plastic material and respective seal guides 31. Each vinyl strip 30 is of a generally square cross-section as can be seen in the several figures and is dielectrically welded to a surface of the thin sheet 15 closely adjacent and parallel to a respective longitudinally extending edge. The material forming the strip 30 is fabricated from the same synthetic resin materials as is the sheet 15 but is dimensionally thicker than the sheet 15 thereby forming a rib projecting from a surface of the sheet. Utilizing the same materials permits utilization of dielectric welding techniques although it will be understood that suitable adhesives may also be used to bond a strip 30 to a surface of the sheet 15 also formed from a synthetic resin. Referring to FIG. 2, it will be seen that the vinyl strip 30 is adhered to a surface of the sheet 15 which faces inwardly to the respective guide and storage rollers 16 and 18 around which the sheet extends. The marginal edge portion of the sheet 15 with the strip 30 thus extends in close parallel relationship to each of the respective side members 11 and also extends through a respective seal guide 31.

Figure 3:
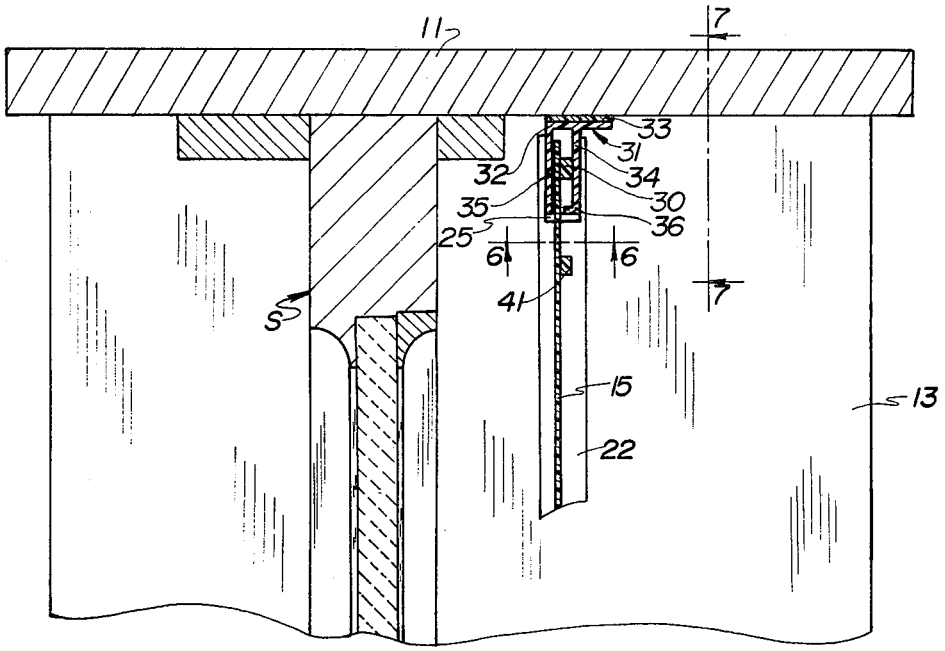
FIG. 3 is a fragmentary horizontal sectional view on a substantially enlarged scale taken along line 3—3 of FIG. 1.

Each of the seal guides 31, may be formed by extrusion processes from an appropriate plastic material and has a configuration in cross-section which can be best seen in FIG. 3. Each guide includes a base or mounting plate 32 which is adapted to be secured to an inwardly facing surface of a respective side member 11 by an elongated strip of adhesive 33. Other well known fastening means may be utilized for attachment of the guides to the frame. Formed with the base plate 32 are a pair of outwardly projecting plates 34 and 35 which are disposed in spaced parallel relationship. The one plate 34 is also formed with a laterally projecting lip 36 at its outer end and that extends toward the opposite plate 35 but terminates in spaced relationship thereto. A small aperture of elongated slot form is thus provided between the vertical edge of the lip 36 and the adjacent surface of the plate 35 with the space being of a width sufficient to admit the thin sheet 15. The spacing of these two plates 34 and 35 of the seal guide is such that the vinyl strip 30 and an associated marginal edge portion of the sheet 15 will interfit in sealing engagement between the opposed surfaces of those two plates with one surface of the sheet in sliding contacting engagement with the plate 35 and the strip 30 in contacting engagement with the other plate 34. This arrangement thus results in an effective air-tight weather seal at the longitudinal marginal edges of the sheet 15. Preferably, the marginal edge portion of the sheet 15 extends sufficiently into the guide 31 so that the strip 30 will normally be spaced from the lip 36.

Figure 7:
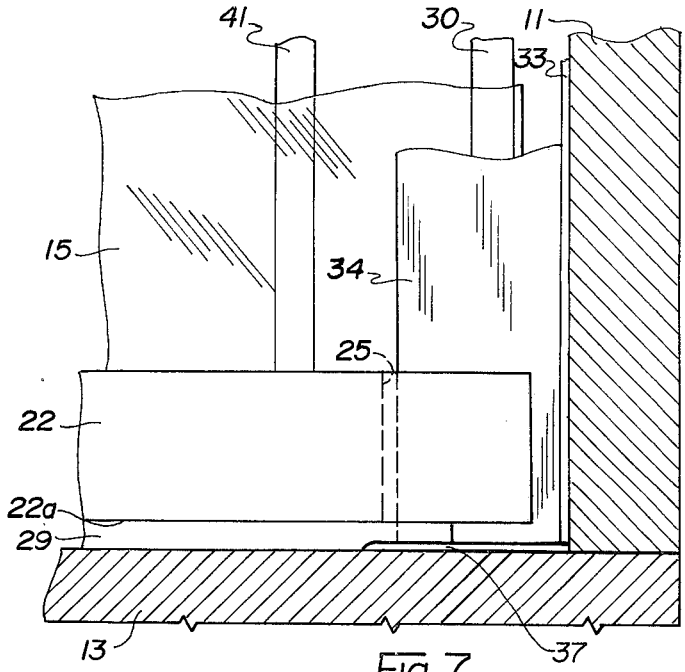
FIG. 7 is a fragmentary vertical sectional view taken along line 7—7 of FIG. 3.

The lower end of the elongated seal guide 31, as can be best seen in FIG. 7, terminates closely adjacent the bottom end member 13 of the window frame and the end of the seal guide may be provided with a further sealing element 37 which assures a further seal as to the lower end of the window structure. This sealing element 37 extends outwardly from the window frame and underlies the entire bottom end of the seal guide 31. Accordingly, the sealing element 37 will also cooperate with the sealing strip 29 in forming an effective seal.

Figure 5:
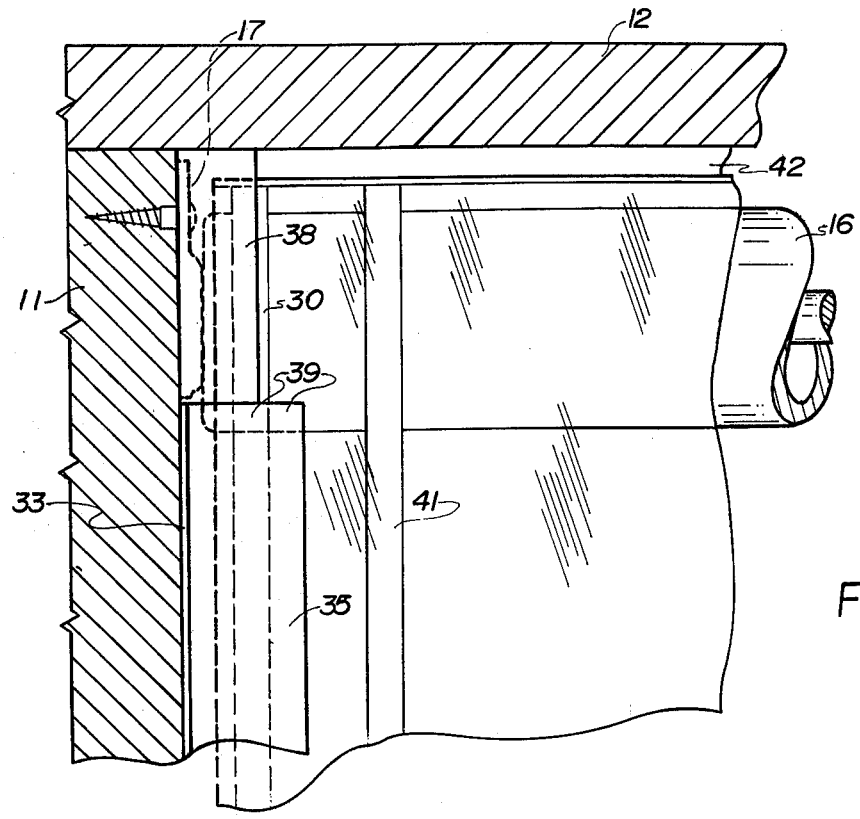
FIG. 5 is a fragmentary vertical sectional view taken along line 5—5 of FIG. 2.

The upper end of each seal guide 31 terminates closely adjacent the guide roller 16, as can be best seen in FIGS. 2 and 5, and completion of sealing as to the guides is accomplished by a small block 38 of weather sealing material. This sealing block 38, which may be formed from the same type of material as sealing strip 29, is adhesively bonded to the vertical surface of a respective window side member 11 and, being formed from a resilient, compressible material, can be deformed and compressed into sealing engagement with the upper end portion 39 of the seal guide base plate 32 and at least a portion of the laterally projecting plate 34. The sealing block 38 is also provided with a generally arcuate surface 40 which is pressed into sealing engagement with the outwardly facing surface of the sheet 15 and thus forms a seal between the seal guide 31 and the surface of the window side member 11.

Referring to FIGS. 3 and 7, it will be seen that each end portion of the pull bar 22, is designed to cooperatively interfit with the respective seal guide 31 to maintain the pull bar in proper alignment therewith throughout its longitudinal movement with the sheet 15. For this purpose, the vertical slots 25 are provided in each end of the bar 22 with these slots being of a width to receive the outwardly projecting plates 34 and 35 of the guide. As seen in FIG. 7, the weather sealing strip 29 extends along the bottom of the pull bar 22 to a point where it will sealingly engage with the inwardly facing edges of plates 34 and 35 of the seal guide 30 and may extend further to overlie the side surfaces of each plate 34 and 35. This overlapping of the weather strip 29 thus completes the formation of an extremely effective weather seal at the base or bottom of the window structure when the pull bar 22 is disposed in its latched or closed position.

Figure 8:
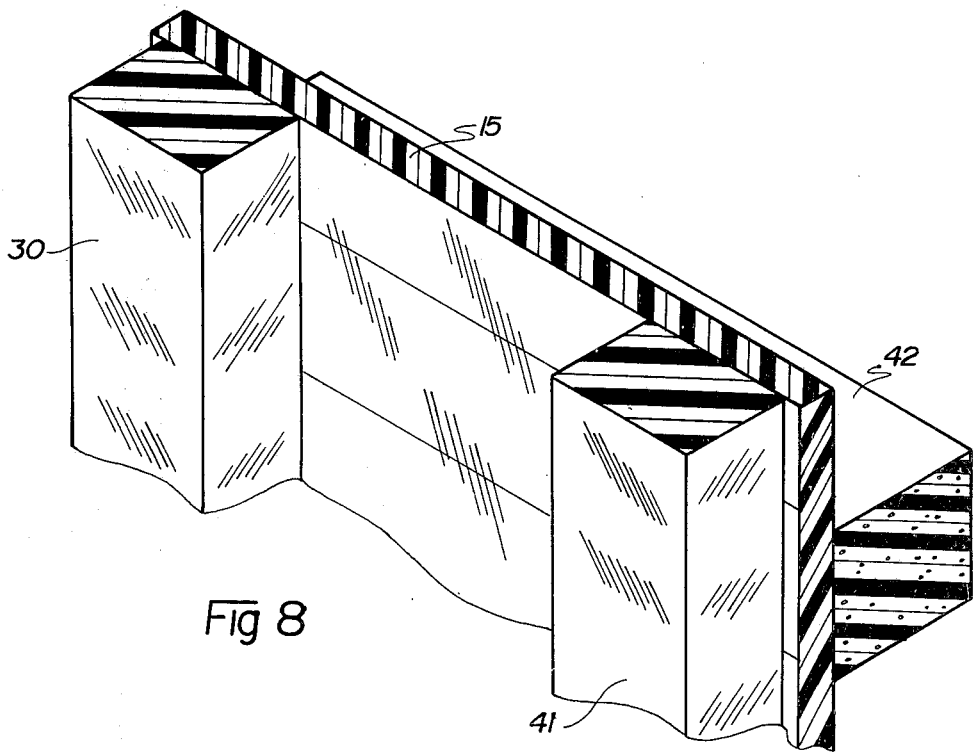
FIG. 8 is a fragmentary perspective view of the flexible sheet on a substantially enlarged scale.

The structure described and specifically illustrated is thus seen to form a particularly effective rollup window 14 that can be readily positioned within a window frame 10. Operation of the structure in movement between an extended or closed position in a retracted or storage position is enabled by the addition of a second elongated vinyl strip 41 similar to the first described strip 30. A pair of such secondary vinyl strips 41 are applied to the same surface of the sheet 15 as the first described strip 30, as by dielectric welding, in inwardly spaced, parallel relationship to the first strip. This arrangement can be best seen in FIGS. 1, 5 and 8 where it will be noted that the second sealing strip 41 is not engaged by nor extend through either of the respective seal guides 31. This strip is formed and configured in identical relationship to the first strip and thus has the same functional characteristics.

It is the functional objective of the second strip 41 to cooperate with the first strip and enable the thin-film sheet 15 to be readily rolled onto the storage roller 18. Its specific functioning can be best seen in FIG. 4 which illustrates several turns of the thin film rolled up onto the storage roller 18. Because of the thickness of the vinyl strips 30 and 41, the spirally wound layers of film as between the two strips will be maintained in a substantially rigid and very stable relationship forming a structurally self-supporting cylinder which will prevent collapse of the film. Utilization of only the one vinyl strip 30 does not result in a structure which would permit a relatively wide sheet to be rolled up onto a roller as indicated in several figures, although a single wide strip may be adequate for a narrow window. The reason for this is that a single strip 30 would form a very unstable structure as it is coiled onto the roller. No lateral support could be obtained from the relatively flexible sheet 15 and consequently, the sheet would tend to shift laterally thereby resulting in a distorted and unmanageable structure. Use of the two parallel strips 30 and 43 overcomes this problem as they cooperate to form a structurally stable cylinder because of the ability of the sheet 15 to provide the necessary lateral stability over a short span. The central area of the sheet 15 intermediate inner strips 41 may not retain this desired rigid structural arrangement but this rigidity is not required over the entire width of the sheet. It is sufficient that a structurally rigid and stable cylinder configuration be maintained at each marginal edge portion at the longitudinal sides of the sheet. This essential rigid and stable structure which is formed in rolling of the film onto the storage roller thus enables the sheet to be rolled onto that roller. A further advantage in utilizing the rib-forming vinyl strips 30 and 41 is that the major surface areas of the sheet 15 are prevented from contacting when the sheet is rolled onto the storage roller 18. This prevents the vinyl sheet material from tending to bond together as may otherwise happen during prolonged periods of storage.

A transverse seal is also formed with respect to the top or first end member 12 of the window frame 10 and the rollup window structure by a transverse sealing strip 42. This transverse strip 42 extends across the sheet 15 and is adhesively bonded to the outwardly facing surface of the sheet. The transverse strip 42 is located longitudinally on the sheet 15 so as to be disposed at the top of the guide roller 16 when the sheet is pulled to a closing position in the window frame and the pull bar latched to the bottom end member 13. In this position, the transverse sealing strip 42 engages the inwardly facing surface of the window frame and also contacts the block 38 to complete the sealing engagement of the several components. Forming the transverse strip 42 from a compressible material similar to sealing strip 29 and sealing block 38 permits the strip to be wound up with the sheet 15 and not disturb the otherwise stable structure achieved by the dual vinyl strips 30 and 41 at the longitudinal side edges of the sheet 15.

It will be readily apparent from the foregoing description of an illustrative embodiment of this invention, that a particularly novel and advantageous rollup window structure is provided. This structure is designed to be particularly effective in forming a weather tight seal as between various surfaces and portions of a window frame. The structure forms an effective seal between the sheet and the seal guides disposed at the vertical side members of the window and is also capable of forming a particularly effective seal with respect to the bottom or top end members of the window frame. The inclusion of a pair of similar longitudinally extending vinyl strips along each marginal side edge of the film to be rolled up onto a storage roller to facilitate opening of the window structure.

Having thus described this invention, what is claimed is:

1. The combination of a window frame having spaced apart, longitudinally extending side members and first and second end members extending transversely between said side members in longitudinally spaced relationship thereby defining a window opening:

a rollup window structure for interpositioning in the window frame comprising a guide roller supported by and extending transversely across the window frame closely adjacent the first end member thereof, a storage roller supported by and extending transversely across the window frame in spaced parallel relationship to said guide roller, an elongated, thin sheet having longitudinal edges and formed from an air impervious flexible material secured at one end to said storage roller and adapted to be selectively rolled up thereon or unrolled, trained around said guide roller and extended across the window frame in closing relationship to the window opening, said sheet being provided with a longitudinally extending flat surfaced rib of predetermined width continuously secured throughout its length along each marginal edge portion thereof in parallel relationship to a respective edge and projecting in upstanding relationship to a surface of said sheet so as to be interposed between said sheet and said guide roller, said sheet carrying a transversely extending weather strip at a position to engage the first end member of the window frame in fluid sealing relationship therewith when said sheet is fully extended, and a rigid structural member attached to an opposite end of said sheet in transversely disposed relationship and displaceable longitudinally with said sheet either into or out of sealing engagement with the second end member of the window frame, and longitudinally extending edge seal guides disposed at and mounted on each vertical side member of the window frame and cooperatively engaging with a respective longitudinal marginal edge portions of said sheet and associated rib in sealing relationship therewith.

2. The structure of claim 1 wherein said transversely extending weather strip is disposed on a surface of said thin sheet opposite that surface provided with said rib.

3. The structure of claim 2 wherein said transversely extending weather strip is formed from a resiliently compressible material.

4. The structure of claim 2 which includes sealing means supported in sealing relationship at each end of said guide roller and forming a continuously operative seal between the adjacent first end member and a respective side member of the window frame, a surface of said thin sheet and a respective edge seal guide, said sealing means also cooperatively interengageable in sealing relationship with said transversely extending weather strip when said strip is in sealing engagement with the first end member of the window frame.

5. The structure of claim 4 wherein said sealing means includes blocks of resiliently compressible material secured to respective window frame side members.

6. The structure of claim 1 wherein each edge seal guide includes a pair of spaced parallel, longitudinally extending plates supported in laterally outwardly projecting relationship to the respective window frame side member, said plates spaced a distance apart to receive a marginal edge portion of said think sheet with a rib in fluid sealing relationship therebetween.

7. The structure of claim 6 wherein each of said edge seal guide plates projects a distance outwardly from the window frame side member to extend beyond said rib, the plate disposed in contacting engagement with said rib provided with a laterally extending lip projecting toward the other plate and defining therewith an elongated slot having a width substantially equal to the thickness of said thin sheet.

8. The structure of claim 7 wherein each said edge seal guide includes a base plate to which said plates are secured, said base plate including attachment means for securing said guide to the window frame.

9. The structure of claim 8 wherein said attachment means is an adhesive.

10. The structure of claim 6 wherein each said edge seal guide extends from the second end member of the window frame to said guide roller.

11. The structure of claim 6 wherein said rigid structural member includes an elongated bar extending across the window frame, said bar having end portions formed with slots for receiving respective ones of said edge seal guides in sliding relationship.

12. The structure of claim 11 wherein said bar includes a resiliently compressible weather strip secured to a surface thereof for forming a fluid seal with the second end member of the window frame.

13. The structure of claim 1 wherein said thin sheet is secured to said storage roller or roll-up thereon with said ribs next adjacent said roller.

14. The structure of claim 1 which includes a second longitudinally extending rib provided on said thin sheet and disposed thereon in inwardly spaced relationship to said first mentioned rib.

15. The structure of claim 14 wherein said ribs are formed from a substantially incompressible materials.

16. The structure of claim 1 wherein said rigid structural member and the window frame are provided with cooperative elements of selectively releasable catching means operative to maintain said roll-up structure in closed relationship to the window frame.

17. The structure of claim 16 wherein said storage roller includes biasing means urging said storage roller to revolve in a direction to roll said thin sheet onto said storage roller.

* * * * *